US006165013A

United States Patent [19]

Broussard

[11] Patent Number: 6,165,013

[45] Date of Patent: Dec. 26, 2000

[54] METHOD AND APPARATUS WATERPROOFING

[76] Inventor: Blaine L. Broussard, P.O. Box 401, Loreauville, La. 70552

[21] Appl. No.: 09/227,134

[22] Filed: Jan. 8, 1999

[51] Int. Cl.[7] ..... H01R 13/58

[52] U.S. Cl. ..... 439/606; 439/693; 439/933; 174/110 SR

[58] Field of Search ..... 439/606, 604, 439/736, 693, 283, 933; 174/110 R, 110 SR, 110 PM, 74 R, 74 A, 74 D

[56] References Cited

U.S. PATENT DOCUMENTS

| | | | |
|---|---|---|---|
| 5,120,268 | 6/1992 | Gerrans | 439/736 |
| 5,362,925 | 11/1994 | Yamaguchi et al. | 174/110 SR |
| 5,387,119 | 2/1995 | Wood | 439/281 |
| 5,521,009 | 5/1996 | Ishikawa et al. | 174/110 SR |
| 5,595,497 | 1/1997 | Wood | 439/282 |
| 5,641,307 | 6/1997 | Gerrans | 439/606 |
| 5,672,640 | 9/1997 | Brauer | 174/110 R |
| 5,776,564 | 7/1998 | Kontants | 428/34.1 |
| 5,885,108 | 3/1999 | Gerrans, Jr. | 430/606 |

*Primary Examiner*—T. C. Patel
*Attorney, Agent, or Firm*—Robert N. Montgomery

[57] ABSTRACT

A method and apparatus is disclosed for waterproofing electrical connectors for use in deep water and abusive environments such as that involving seismograph underwater exploration. The present invention combines the technology expressed in the referenced prior art with a method for sealing pin wiring connections and bonding the wiring sheath insulation to a pliable molded body surrounding a central core encompassing the connectors pins in a single injection molding operation. The process includes providing a length of special cable having one or more conductors with multiple sheaths for attachment to an underwater type cable connector having at least one sheath compatible with the injection molded body, the compatible sheath and a portion of its compatible outer jacket being integrally molded to form the connector's body. A water-block is also provided to prevent back flow of water under pressure from being forced between the conductors and between strands of the conductors and entering the connector of a main supply cable if the cable jacket is torn.

4 Claims, 3 Drawing Sheets

METHOD AND APPARATUS WATERPROOFING

BACKGROUND OF THE INVENTION

1. Field of the Invention

This invention relates generally to watertight electrical connectors for underwater service and more particularly to an improvement in the watertight integrity of such connectors.

2. General Background

Electrical connectors used in an underwater environment are subjected to stress, especially when used in deep water or in seismic exploration where high pressure, explosive forces, and underwater hazards can cause the connectors to leak, thus causing failure of the electrical connection. Connector failure due to leakage can cause the entire system to fail as a result of loss of watertight integrity within the electrical cable. Most underwater cable connectors utilized in the prior art recognize the need to protect the connectors from high pressure, potential connector separation, and absorption of explosive impact pressure by providing impact absorbing materials molded in place around the cable jackets and the connector pins. Various methods have also been employed in sealing the connector pins themselves as disclosed in U.S. Pat. Nos. 5,120,268, 5,387,119, 5,595,497, and 5,641,307. The U.S. Pat. No. 5,595,497 patent discloses a central core molded around the pins and enclosed within a relatively soft plastic body. The soft body is molded around the wires attached to the pins and also extends over a portion of the electrical cable jacket. It is further disclosed that the central core should be bonded, during the molding process, to the soft body, thus, at least in theory, providing a watertight seal between the open face of the connector's pins and the wiring connections. However, in reality, if the central core does not form a complete bond with the body, leaks can occur under high pressure. Further, no steps are taken to insure a bond between the individual wiring dielectric insulation or sheath and the molded soft body. In many cases, the molding material and the wiring insulation material are dissimilar and therefore do not bond. Wiring conductor insulation is often a thermoplastic material, such as polypropylene, which provides excellent dielectric qualities at an economical cost and prevents the electrical conductors from adhering together under heat and pressure during manufacture and storage. However, the thermoplastic polypropylene, used as a molding material in the connectors discussed above does not allow the two materials to bond without the introduction of a chemical bonding agent. It has also been observed that extreme care must be taken to insure that the polyurethane molded body material always forms a complete fill around the wiring connection to the connector's pins. Others have observed this problem and have attempted to solve the problem for a particular need, such as that disclosed by U.S. Pat. No. 5,776,564 which addresses the problem of bonding a polyamide-based mixture for its connector body to a polytetrafluoroethylene wiring insulation by coating the insulation with a thermoplastic elastomer on a polyester basis. This process, while allowing a chemical bond between the two components is only useful with specific wire coatings and then only with a specific body matrix. There is no proof that the process mentioned by the U.S. Pat. No. 5,776,564 disclosure will provide a chemical bond with any and all combinations of thermoplastic material nor does it purport to provide a water proof seal. Therefore, several claims were made to include various combinations, none of which include the use of polyurethane or the process of multiple removable sheaths as disclosed herein.

Connectors which are principally used under water and subjected to high pressure and continuous heavy abuse must insure watertight integrity. Further, the process of insuring comparability must be uniform without the need for chemical analysis of each component during the molding process.

It therefore follows that, if a tear or rip in the cable jacket occurs adjacent the cable connector, water is allowed to enter the cable under pressure and migrate along the conductors sheaths. If no permanent seal exists between the wiring insulation and the molded connector, water is allowed to ultimately reach the connector pin connection, in which case a short circuit occurs between the affected pins. Further, water may also be forced into whatever the cable and its connector is attached to opposite the connector, such as a main cable splice, thus affecting other connectors fixed thereto, which may result in catastrophic failure of the entire system.

If an incomplete fill occurs during molding of the connector, a void may develop which may fill with water due to leakage, thus causing a direct short circuit between the pins or at least a reading to ground.

SUMMARY OF THE INVENTION

The present invention is directed to overcome the problems set forth above and thereby complete the waterproofing process of underwater connectors. The present invention combines the technology expressed in the referenced prior art with a method for sealing in and around the pin wiring connections and bonding the wiring sheath insulation to a molded body surrounding a central core encompassing connectors pins. The process includes providing a length of special cable having multiple conductors with multiple sheaths for attachment to an underwater type cable connector, the cable and a portion of its outer jacket being integrally molded to form the connector's body and the cable having one or more conductors with removable dielectric sheaths, at least one of which is capable of bonding with the molded connector body during the molding process.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein.

DETAILED DESCRIPTION OF THE PREFERRED EMBODIMENT

Figure 1:
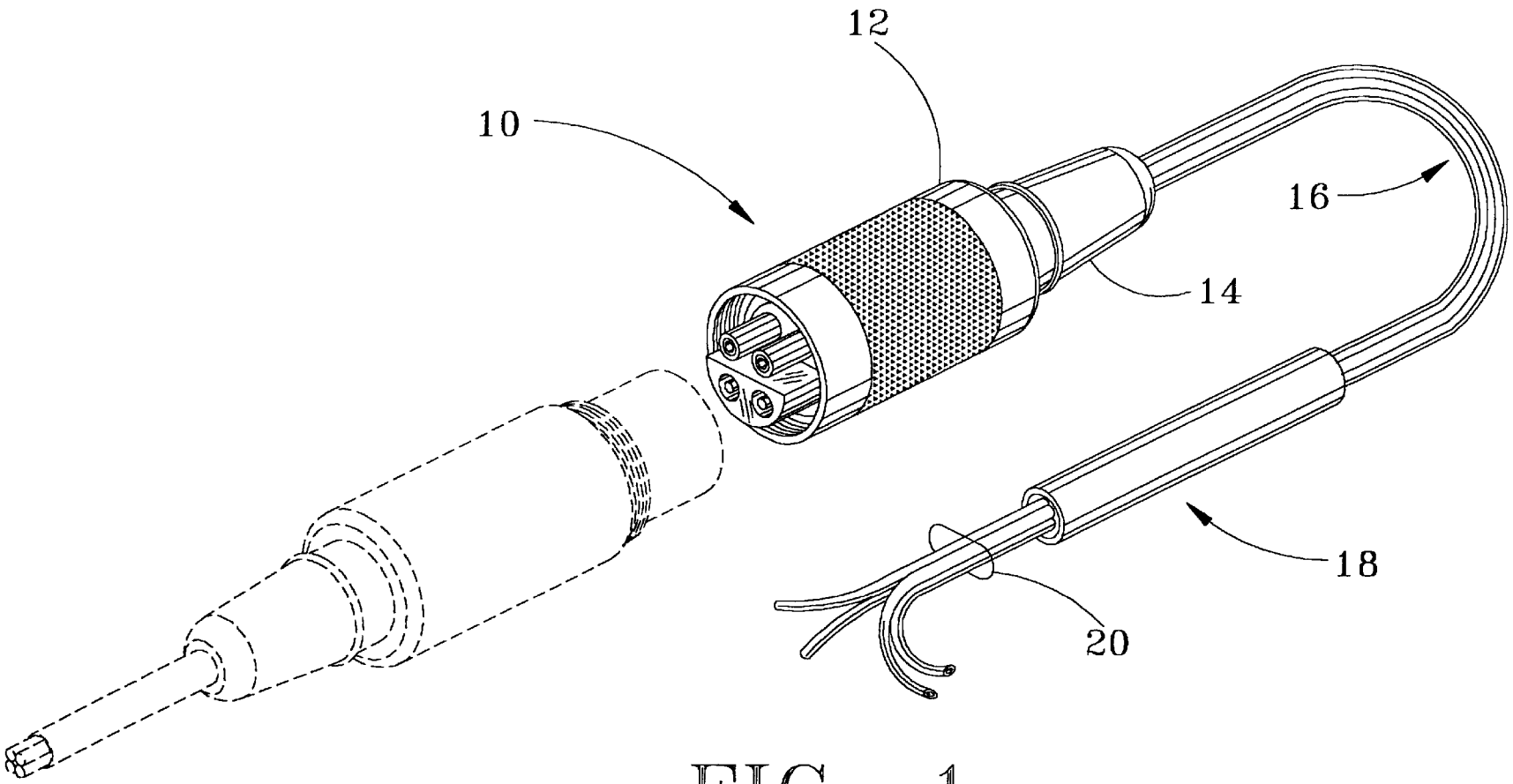
FIG. 1 is an isometric view of a molded underwater connector and pig-tail cable with water block.
Figure 2:
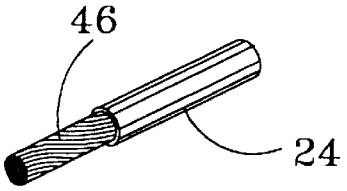
FIG. 2 Prior Art
FIG. 2 is an isometric close-up illustration of the prior art insulated sheathing used for wiring conductors illustrated in FIG. 1.
Figure 3:
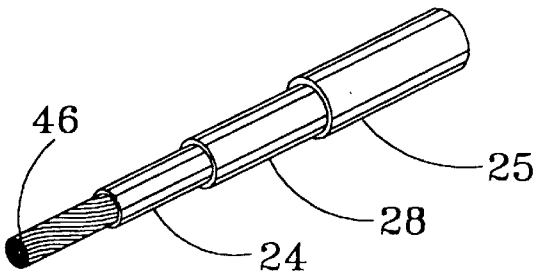
FIG. 3 is an isometric close up illustration of the preferred insulation sheathing for wiring conductors illustrated in FIG. 1.
Figure 4:
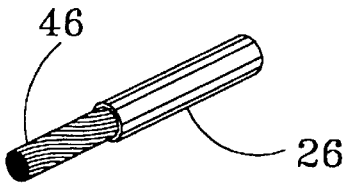
FIG. 4 is an alternate insulation sheathing for wiring conductors illustrated in FIG. 2.
Figure 5:
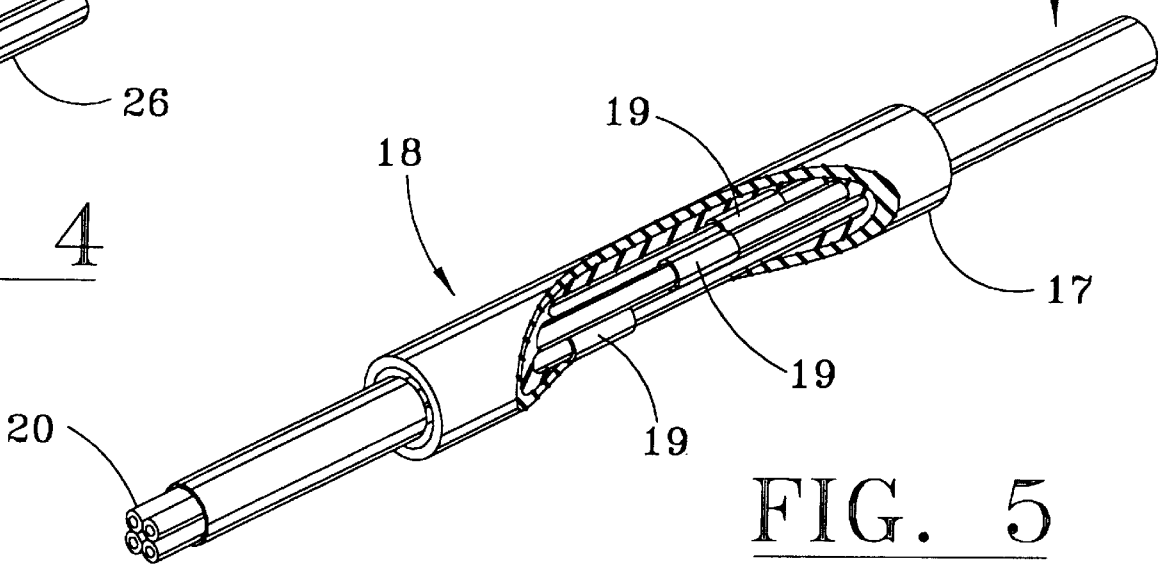
FIG. 5 is a cut-away view of the water-block illustrated in FIG. 1, illustrating the wiring conductor connections.

Illustrated in FIG. 1 is a hermaphrodite type, open-face waterproof connector assembly 10 which includes a mating pair of connectors held in close proximity by a relatively hard, rotatable, external coupling sleeve 12 surrounding a flexible, molded, polymeric body 14, an electrical cable 16 molded thereto, and a water-block 18 for splicing and sealing the conductors 20 of the cable 16 and thus preventing back flow of water into a main supply cable which may be connected to the conductors 20. The ends of the conductors within cable 16 are connected to corresponding conductors 20 leading away from the water-block 18 by soldered connectors 19 which provide a water barrier for the conductor wire stands and are compatible with the molded, polymeric body 17 as seen in FIG. 5. However, it is essential that the conductor sheathing 24 seen in FIG. 2 form an effective bond with the polymeric body 17 which encapsulates the conductors 20 and their connectors 19 to form a effective, watertight barrier seal. Since most wire sheaths 24 are polypropylene, which does not bond well with polyurethane, the preferred polymeric material for the water-block body 18 and the connector body 14; therefore, a compatible sheathing material must be selected, such as the Teflon sheath 26 illustrated in FIG. 4. Teflon is an expensive material and does not have the dielectric properties of the polypropylene usually used for underwater electrical cables; therefore, an alternative is herein suggested, as illustrated in FIG. 3, whereby a cable is provided having multiple conductors with each conductor having at least one removable thermoplastic material sheathing such as polyurethane 28, as an intermediate sheath applied to the conductors 20 between inner and outer sheaths 24, 24', such as polypropylene. Therefore, by stripping the outer sheath 24' within the water-block polymeric body 17 and thus exposing a portion of the intermediate polyurethane sheath 28, a compatible chemical bond is achieved between the polyurethane body 14 and conductor sheaths 28.

Figure 6:
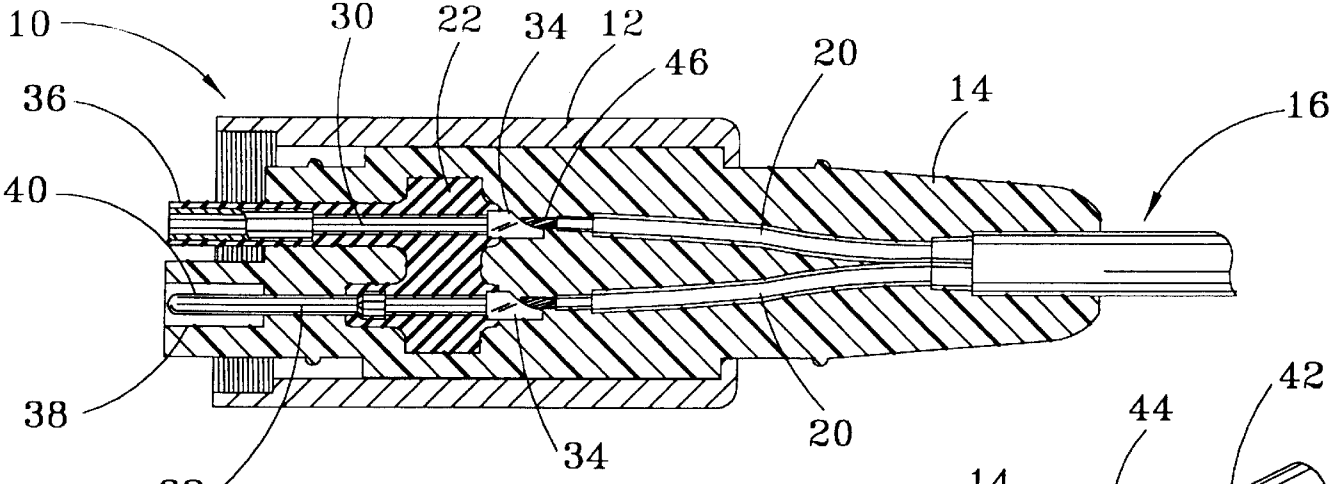
FIG. 6 is a cross section view of the connector illustrated in FIG. 1.

Turning now to FIG. 6, we see that the polymeric, molded body 14 encapsulates the pin connection block 22, which is a semi-ridged, molded polymeric block containing the connector pins 30,32 in a spaced apart arrangement. The block 22 may be a glass filled polyurethane material which chemically bonds readily with the polyurethane body 14. The pins 30,32 may include a plurality of all male 32 or female pins 30 or a combination thereof. The female pins 30 can be sheathed 36 in the same material as that used for the block 22, which insures a complete chemical bond with the polymeric body 14 and insures a complete seal with a socket 38 formed in the opposing body 14 around an exposed portion 40 of the male pin 32 when molded as an integral unit. With the wiring conductors 20 soldered or otherwise connected to the pins 30,32 at the connector block 22, the polymeric body is then molded in place as shown in FIG. 6. The body 14 fully encapsulates the connection block 22, the wiring conductors 20, and a portion of the cable 16.

Figure 7:
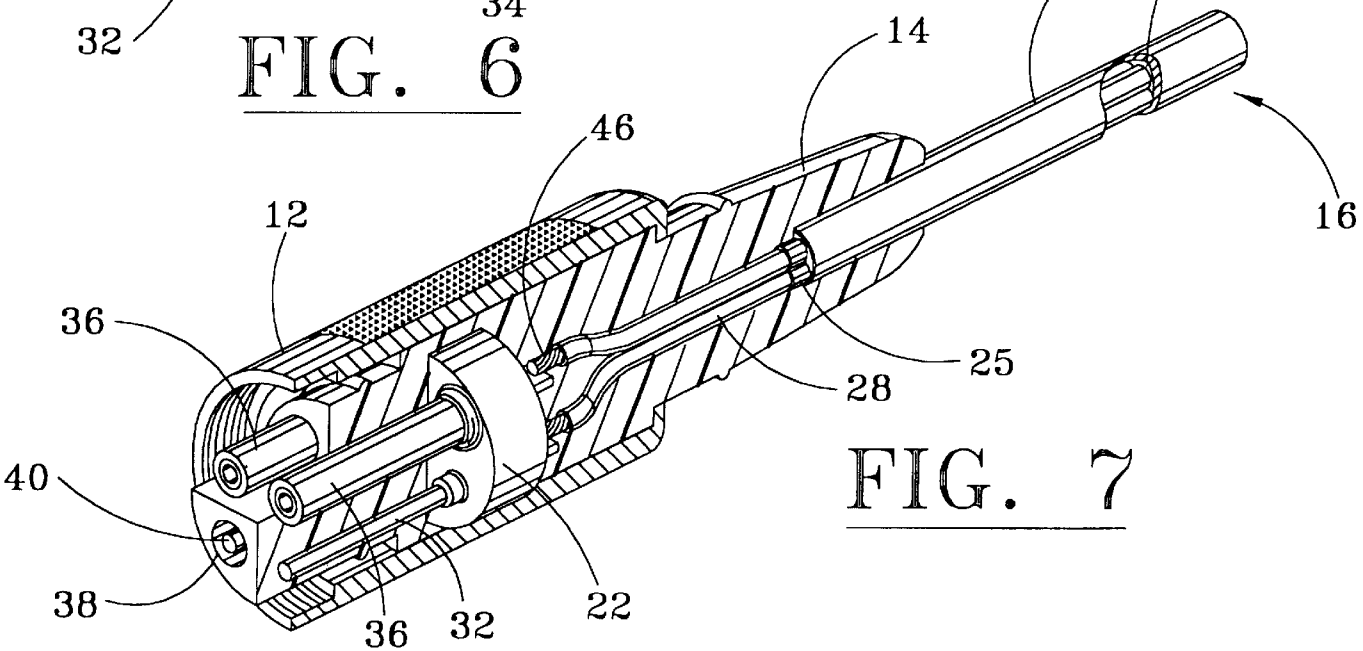
FIG. 7 is an isometric cutaway section view of the pin connection block illustrated in FIG. 6.

Ruptures 42 in the jacket 42 of the cable 16, as seen in FIG. 7, may occur as a result of snags along the sea bed, cable retrieval handling, etc. In any case, water is allowed to penetrate the cable, migrating along the conductors 20 towards the water-block 18 and towards the connector 10. As discussed above regarding the water block, if the conductor sheath 24 is not sufficiently bonded to the polymeric body 14, it can reach the pin connection sockets 34, seen in FIG. 7, thereby causing an electrical short circuit. Water may also be siphoned back through the wiring strands 46. Therefore, it is advisable to block this water path through the strands 46 at the water-block 18 connections 19 seen in FIG. 5. As seen in FIGS. 6 and 7, it is essential that the conductors 20 bond sufficiently with the molded polymeric body 14 to prevent water migration within the body 14. Therefore, at least one of the conductors sheaths must be chemically compatible with the polymeric body, material during the the molding process to insure a good bond. If the cable carries conductors 20 having sheaths as seen in FIG. 3 and described above, the outer sheath 24' may be stripped back, thus exposing an intermediate sheath 28 which is readily bondable with the polymeric body 14 during molding.

It is anticipated that this process of sealing the cable conductors 20 will allow a number of waterproof connectors to utilize a soft inner body arrangement and insure watertight integrity against back flow of water into the connectors as a result of rips or tears in the cable jackets. Connectors and water blocks can also be made more economical and still prevent intrusion of water from either end of the cable.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in any limiting sense.

What is claimed is:

1. A waterproof plug connector assembly comprising:

a) a waterproof connector plug comprising i) at least one electrical contact element:

ii) at least one electrical conductor attached to said at least one contact element;

iii) a first insulation sheath surrounding said conductor;

iv) a second insulation sheath, made of polyurethane, surrounding said first insulation sheath;

v) a third insulation sheath surrounding said second insulation sheath;

vi) an enclosure of a flexible polyurethane material molded around said contact and said conductor, said housing being bonded to said second insulation sheath and said contact; and b) a water-block assembly attached to said at least one electrical conductor, said water-block assembly interposed along said conductor adjacent said connector plug said water-block assembly comprises at least one splice connector for each said electrical conductor, said splice connector having means for transmitting electrical current while blocking passage of water internally through said conductor, said splice connector, and a second electrical conductor identical with said at least one electrical conductor fixed to said splice connector having at least a portion of their said third insulation sheaths removed and their said second insulation sheaths being surrounded and bonded thereto in a molded urethane sheathing.

2. The waterproof plug connector assembly according to claim 1 wherein said water-block assembly having a plurality of electrical conductors, each conductor being spliced and each said splice connector being sealed within said molded urethane sheath, said water-block further comprising a second polyurethane sheathing mesial and surrounding said plurality of conductors and splice connectors bonded to said second sheaths and said molded urethane sheathing covering said splice connector.

3. A waterproof plug connector assembly comprising:

a) a plug connector comprising:

i) at least one electrical contact element:

ii) at least one electrical conductor attached to said at least one contact element;

iii) a first insulation sheath surrounding said conductor;

iv) a second insulation sheath, made of polyurethane, surrounding said first insulation sheath;

v) a third insulation sheath surrounding said second insulation sheath;

vi) an enclosure of a flexible polyurethane material molded around said contact and said conductor, said housing being bonded to said second insulation sheath and said contact; and b) a water-block assembly attached to said at least one electrical conductor, said water-block assembly interposed along said conductor adjacent said plug connector comprises at least one splice connector for each said electrical conductor, said splice connector having means for transmitting electrical current while blocking passage of water internally through said conductor, said splice connector, and a second electrical conductor identical with said at least one electrical conductor fixed to said splice connector having at least a portion of their said third insulation sheaths removed and their said second insulation sheaths being surrounded and bonded thereto in a molded urethane sheathing.

4. The waterproof plug connector assembly according to claim 3 wherein said water-block assembly having a plurality of electrical conductors, each conductor being spliced and each said splice connector being sealed within said molded urethane sheath, said water-block further comprising a second polyurethane sheathing mesial and surrounding said plurality of conductors and splice connectors bonded to said second sheaths and said molded urethane sheathing covering said splice connector.

* * * * *